United States Patent [19]

Meyers

[11] Patent Number: 4,769,926

[45] Date of Patent: Sep. 13, 1988

[54] INSOLE STRUCTURE

[76] Inventor: Stuart R. Meyers, 2910 Wallace Ave., Bronx, N.Y. 10467

[21] Appl. No.: 77,089

[22] Filed: Jul. 22, 1987

Related U.S. Application Data

[63] Continuation of Ser. No. 914,569, Oct. 3, 1986, abandoned, which is a continuation of Ser. No. 822,958, Jan. 27, 1986, abandoned, which is a continuation-in-part of Ser. No. 724,038, Apr. 17, 1985, abandoned, which is a continuation-in-part of Ser. No. 473,334, Mar. 8, 1983, abandoned, which is a continuation-in-part of Ser. No. 438,389, Nov. 1, 1982, abandoned, which is a continuation-in-part of Ser. No. 196,020, Oct. 10, 1980, Pat. No. 4,445,283, which is a continuation-in-part of Ser. No. 970,010, Dec. 18, 1978, Pat. No. 4,297,797.

[51] Int. Cl.[4] ..... A43B 13/38

[52] U.S. Cl. ..... 36/43; 36/44; 36/91; 128/595

[58] Field of Search ..... 36/44, 43, 31, 32 R, 36/88, 93, 91; 128/581, 596, 595, 614

[56] References Cited

U.S. PATENT DOCUMENTS

| | | | |
|---|---|---|---|
| 2,068,786 | 1/1937 | Balaskas | 36/44 X |
| 4,240,214 | 12/1980 | Sigle et al. | 36/43 X |
| 4,364,189 | 12/1982 | Bates | 36/31 |

FOREIGN PATENT DOCUMENTS

| | | | |
|---|---|---|---|
| 2709546 | 9/1978 | Fed. Rep. of Germany | 36/44 |
| 2751146 | 5/1979 | Fed. Rep. of Germany | 36/31 |
| 2907506 | 9/1980 | Fed. Rep. of Germany | 36/44 |

*Primary Examiner*—James Kee Chi

*Attorney, Agent, or Firm*—Ostrolenk, Faber, Gerb & Soffen

[57] ABSTRACT

A footwear heel disposed between the foot contacting and ground contacting surfaces member, preferably part of a complete heel to toe device, comprising in transverse cross-section a lower posting portion at the bottom surface sloping upwards towards the medial side wall and being less elastically compressible than the remaining upper portion of said member, the lateral and medial sides of said cross-section being substantially symmetrical with each other whereby the thickness of the upper more elastically compressible portion increases as the thickness of the lower posting portion decreases towards the lateral side of said member.

9 Claims, 1 Drawing Sheet

INSOLE STRUCTURE

This application is a continuation of my application Ser. No. 914,569, filed Oct. 3, 1986, now abandoned, which is a continuation of my application Ser. No. 822,958, filed Jan. 27, 1986, now abandoned, which is a continuation of my application Ser. No. 724,038, filed Apr. 17, 1985, now abandoned, which is a continuation of my application Ser. No. 473,334, filed Mar. 8, 1983, now abandoned which is a continuation-in-part of my application Ser. No. 438,389 filed Nov. 1, 1982, now abandoned which is in turn a continuation-in-part of my application Ser. No. 196,020 filed Oct. 10, 1980 and now U.S. Pat. No. 4,445,283, dated May 1, 1984, which is in turn a cont.-in-part of my application Ser. No. 970,010 filed Dec. 18, 1978 and now U.S. Pat. No. 4,297,797 dated Nov. 3, 1981, the disclosures of which prior applications and patent are incorporated herein by reference thereto.

The "Background and Description of the Prior Art" in lines 9–55 of column 1 of my said U.S. Pat. No. 4,297,797 are applicable to the present application. Reference is also made to the "References Cited" in my said patent. None of the references cited or otherwise referred to in my said patent teach the invention disclosed and claimed in said patent or prior applications or more particularly in this application.

According to the invention described in my said patent, a footwear member disposed between the foot contacting and ground contacting surfaces is provided comprising a medial portion less compressible than the lateral and metatarsal portions whereby the weight of the foot undergoing compression in the lateral and metatarsal portions dynamically forms a medial arch. The member is mainly described as formed of a multiplicity of compressible fluid filled chambers, the variation in compressibility between the medial portion and the remaining portions being achieved by suitable adjustment or selection of the sizes and/or wall thickness and the like of the chambers in the respective portions.

According to the invention disclosed in my said application Ser. No. 438,389, a footwear insole member is provided comprising a first portion the area of the upper surface of which approximately underlies the area of the longitudinal arch and a second portion the area of the upper surface of which underlies at least about 10% of the medial area of the heel and from 0 to about 50% of the lateral area of the heel, the border of the area of the upper surface of said second portion including about 10% to about 65% of the outer edge of the heel area, said first and second portions being less compressible than the remaining portions of said member.

U.S. Pat. No. 4,338,734 issued July 13, 1982 on application filed Feb. 22, 1980 and entitled "Universal Orthotic" discloses an appliance, the structure of which includes a monolithic shell of at least heel to ball length, made of semi rigid material such as flexible molded rubber and having a medial heel post, a navicular flange and a metatarsal raise, said shell being covered with a layer of cushioning, shock-absorbing sponge material such as polyethylene foam. This structure provides insufficient cushioning and shock absorption at the instant of heel contact (impact), and causes the user's foot to be improperly positioned in the shoe in a pretitled position. This appliance is obviously not solely for heel support nor was it designed with the concept of lateral column depression based on the utilization of body weight and gravity, or on preventing anterior posterior shear forces from excessively moving thru the foot. There is in effect no dynamic quality to the orthotic. The orthotic does not allow for the lateral column to function as a flexible unit. Since the post means pretilts the foot, when heel impact is made the heel posting going all the way to the lateral side, leaves the foot in danger of instability and can cause inversion sprains of the ankle. Since the shell is of one piece, there is no true compression or density disparity, or selectively constructed cup wedge arrangements which could be specifically placed to control various anatomic features of the foot and thereby control the forces going thru the foot from the leg above and the ground reactive force below.

U.S. Pat. No. 4,360,027 issued Nov. 23, 1982 on an application filed June 29, 1981 and entitled "Thin, Light-Weight Flexible Orthopedic Device" discloses a device, the structure of which includes in one piece, a distal forefoot supporting section, a medial arch supporting section and a heel supporting section, and posting means for raising the elevation at the medial side of said sections, said posting means being "a bottom flexible layer" covered by a middle "thermoplastic" layer and a top covering layer of leather or leatherette. This structure provides even less, if any cushioning, shock absorption, etc. This system is certainly not a dynamic system, based on movement of major joints of the foot and leg at certain times within the gait cycle, with the use of body weight and gravity. Upon further examination of this orthopedic device it is seen that the lateral plantar position of the heel is in contact with the hard ground and therefore compressibility, cushioning and shock absorption on the lateral side is non-existent. This orthopedic device under scrutiny is obviously an attempt to place a standard static non-elastically compressible orthotic into stylish shoes by cutting out its bottom surface so the foot and orthotic will have room to enter most shoe gear. There is also in this invention a lack of adequate rearfoot control thereby failing to eliminate anterior-posterior shearing forces going through the foot.

The ordinary shoe is described mainly to protect the foot against more or less hard surfaces, a shoe not being necessary at all, for example, when such surface is loose soft sand. The soft sand permits ready control and maintenance of both the rearfoot and forefoot stability perpendicular to the forces transmitted through the tibial shaft. The sand acts as a natural shock absorber distributing the strike loadings of each stride over a relatively long time period so that the foot has time to be balanced by supporting muscle contractions while the shock loadings are dissipated into the sand. As the sand becomes harder, e.g. to the hardness of asphalt or concrete, more of the strike forces (vertical compression forces, anterior posterior shear force, medial and lateral shear force and tortional force of the leg and their corresponding velocities) have to be absorbed and dissipated by the rearfoot which is functioning as a torque convertor for the leg. These compressive forces can be very high. For example, when a 150 lbs. individual walks for one mile with a step length of 2½ feet, he takes about 2110 steps. Thus, at initial ground contact with an impact of 80% of body weight, he absorbs a total of 253,200 pounds (127 tons) or 53½ tons on each foot. If the same individual runs one mile taking steps of 4½ feet, which would result in about 1175 steps, he absorbs an initial ground contact, considering an impact of 250% of body weight, a total of 440,625 pounds (220 tons) or 110 tons on each foot.

The point is that at heel contact and midstance the vertical compression force can be 250%–300% of body weight with an anteriorposterior (aft shear) equal to approximately 60% of the body weight.

This force also is of very short duration during heel contact and therefore it is at this critical point that the forces must be controlled, and dissipated. It is at this time that the motion of the major articulations of the rearfoot complex is susceptible to excessive movement and overloading, with resultant excessive rearfoot complex pronation in most people, limiting effective ambulation.

As used herein, pronation is flattening of the medial longitudinal arch (also referred to as lowering of the medial column of the foot by virtue of the heel rolling medially or everting, which is also called rearfoot pronation), and the reverse which is called supination of the rearfoot, (inverting of the heel or lateral heel roll which lowers the lateral column of the foot). It should now be noted that since the axes of all major joints of the foot are at an angle to all three body planes, movement of these joints must go through all three body planes. Therefore pronation is in actuality abduction (transverse plane), eversion (frontal plane) and dorsiflexion (sagital plane), and is the decelerating or braking or shock absorbing mechanism of the foot. Supination on the other hand is the stabilization of the osseous segments of the foot into a rigid lever for propulsion (acceleration). Supination is also a triplane movement of plantar flexion (sagital plane), inversion (frontal plane), and adduction (transverse plane). It will be noted that supination and pronation are in reality clockwise and counterclockwise rotations about oblique axes and that controlling or stopping the motion in one plane stops the motion in the other two planes.

For a better understanding of the objects, functions and advantages of the insole member of this invention and its component parts, there follows a discussion of the functional anatomy of the lower extremity, the dynamics of the gait cycle, and the forces in and through the foot.

At the top of the supra structure of the lower extremity is the pelvis which has a rotating motion internally and externally or seen as clockwise and counter clockwise. Next is the hip which is a ball and socket joint and also moves internally and externally or seen as clockwise and counter clockwise. Proceeding downward, the leg, is seen as having movement on a vertical axis and the movement is internal and external rotation or clockwise and counter clockwise movement.

The foot and ankle will be discussed together since functionally they work as a unit called the rearfoot complex. Motion is this anatomical segment is about oblique axes and therefore these joints (ankle, subtalar joint and midtarsal joint) function as oblique hinges moving again either clockwise or counter clockwise depending on what part of the gait cycle the limb is in. The rearfoot complex involves the ankle and the subtalar joint.

The heel of the foot functions as a ball rolling medially and anteriorly in pronation and laterally and posteriorly in supination. The foot functions as a heel (ball) attached to two columns (or arches) medial column and a lateral column. The medial column (depressing) is utilized in standing and in the pronatory or shock absorbing phase of gait. The lateral column lowering is used in walking or the supinatory phase of the gait cycle when the foot must become a rigid lever for propulsion. It must be noted that when the lateral column is lowered it also inverts (by virtue of the movements of the major joints of the foot around their oblique axes). In the same concept, when the lateral column raises, it also everts.

The leg is attached to the foot via the rearfoot complex and the rearfoot is attached to the forefoot via the midtarsal joint. In this rotary system the major joints function as oblique hinges moving clockwise or counterclockwise depending on where force is applied.

Coming to the dynamics of the gait cycle, at heel contact the heel rolls medially and anteriorly to bring the forefoot on the ground and to bring the velocity of the leg to zero. The medial column is simultaneously lowered and the lateral column is simultaneously raised. The forefoot reaches the ground (midtarsal hinge opens up and stops when the velocity of the leg reaches zero). At this point the leg stops internally rotating as it was the initiation of the hip, thigh, knee flexion, and leg internally rotating which initiated all the foot movement.

At this point the situation begins to reverse itself and the leg begins to externally rotate from it's internally rotated position. The heel (ball) reverses it's direction and the lateral column of the foot goes down (depresses and goes in, due to the position of the axis of the subtalar joint). This shows that in this rotary system oblique hinges move as they were designed to move (clockwise or counterclockwise). This is all dependent on where force is applied. The reactive force of the ground pushing up on the lateral column moves the heel medially and anteriorly and depresses the medial column, and force applied to the medial portion of the heel will cause the ball to move laterally and depress the lateral column of the foot (depresses and inverts).

The heel now lifts off, and the limb rotation in an external direction continues to occur at the hip, thigh, leg and ankle. Then finally the foot leaves the ground and the cycle is over.

The system of this invention has many biomechanical advantages which will become apparent as this description proceeds, but a key feature is that the torsional force from the leg above and the ground reactive force from below manifest themselves in an anterior and posterior shear component force, medial and lateral shear component force and an anterior-posterior, medial and lateral shear component force velocity, which have to be controlled in the early part of the gait cycle and redirected in the mid to latter portion of the gait cycle. The instant system, as distinguished from the prior art, will do this effectively and efficiently, and consistent with current technology it can be mass produced.

Since the foot acts as a torque converter, torque being a rotational force, which is a function of body weight, and gravity above and the ground reactive force below, the foot must be controlled by an oblique system that redirects the forces at the time needed in the gait cycle. The instant insole member concept utilizes Newton's Law of physics--for every reaction there is an equal and opposite reaction. A static system fails to control the dynamic forces going through the foot.

Everything within the gait cycle must occur sequentially and thus be a function of time. Therefore pronation in the rearfoot (anterior posterior shear force, which is the braking action of the foot) must be controlled in the initial part of the gait cycle after heel contact, and then the foot must stabilize itself before full body weight (vertical force component) occurs at mid-stance phase of the gait cycle. The instant system guarantees that the osseous stability of the foot must occur in the correct sequence in the gait cycle (function of time) because lowering of the lateral column of the foot occurs as more vertical component force is applied in the instant insole member. The heel (ball) must move to the area of least resistance under full vertical compression force and if the only motion available to the joint is clockwise or counterclockwise then the foot is forced to stabilize itself (heel inverts lowers lateral column) at the time needed in the gait cycle, and the resulting more efficient lever system facilitates propulsion.

The forces going through the foot which are optimally controlled with the instant system include:

1. The vertical compressive force which is a function of body weight and gravity pushing down on the ground and the ground reactive force pushing up on the foot (Newton's Law).

2. The horizontal force which is the (aft shear and foreshear) anterior-posterior shear component force in the direction of progression which is involved in elongation of the foot and is the braking mechanism of the foot helping to bring the velocity of the leg to zero (pronation) and accelerating in the supinatory aspect of the gait cycle.

3. The transverse force which is the shear component moving medially and laterally in the stabilizing foot.

4. The torque force which is a rotational force from the leg above being dissipated in the foot.

5. Finally, the center of force or the center of pressure which is the sum of the vectors of all the above forces at any one time in the gait cycle.

All the above mentioned forces are also a resultant of the force component velocities in each of the aforementioned categories of force components.

Novel and effective control of the forces in one direction and the use of the knowledge of the motions available at the major joints of the foot, to redirect these force components is the conceptual basis for the support system of the instant insole member.

One object of the invention is the provision of a footwear insole member which will not be subject to one or more of the abovementioned deficiencies of the prior art.

Another object of this application and invention is to further elaborate on the functions and advantages of the device disclosed in my U.S. Pat. No. 4,297,797 and my U.S. application Ser. No. 438,389.

Still another object of this invention is to provide an insole member which is further improved relative to the insole member disclosed and/or claimed in my said patent and applications and in the prior art.

Yet another object of this invention is the provision of an insole member which is more economical and/or simple to make or mass produce and/or lighter in weight and/or more insulative relative to the insole member of my said patent and applications and the prior art.

Yet a further object of this invention is the provision of a insole member providing further improvements with respect to comfort, cushioning, shock absorption, prevention of excessive medial roll and/or forward slip of the heel, and/or better or more efficient biomechanical functions relative to the insole member of my said patent and applications and the prior art. Increased cushioning or impact provides the dynamic load displacement necessary in ambulation and all sports activities.

Another object is to provide a system which controls all five component forces and all five component force velocities, the most important of which is anterior posterior shear forces, and thereby altering the center of force or center of pressure.

And another object of this invention is the provision of a footwear insole member with the foregoing attributes for use only as a heel-support.

Other objects and advantages will appear as the description proceeds.

The attainment of one or more of these and other objects and advantages is made possible by this invention which comprises as an essential feature a footwear heel insole member comprising in transverse cross-section a lower posting portion at the bottom surface of said member, the upper surface of said lower posting portion generally sloping upwards towards the medial side wall of said member, said lower posting portion being less elastically compressible than the remaining upper portion of said member, the upper surface of said member being generally contoured in conformance with the bottom surface of the heel of the foot, the lateral and medial sides of said member being of substantially similar thickness at points equidistant from the outer edges thereof whereby the thickness of said upper more elastically compressible portion increases as the thickness of said lower less elastically compressible posting portion decreases towards the lateral side of said member.

The above-defined heel insole member may be provided with further improved biomechanical functions when the upper surface of that segment of said lower posting portion anterior to the calcaneal tubercles has a substantially greater (steeper) posting slope than the remainder of said lower posting portion beneath the calcaneal tubercles, preferably with said segment extending transversely from the medial side wall of said member to the bottom surface of said member anterior to the lateral calcaneal tubercle. According to a further preferred embodiment, said (posterior) remainder of said lower posting portion extends transversely from the medial side wall of said member to the bottom surface of said member substantially beneath the medial calcaneal tubercle.

According to a further feature of the invention, a more complete footwear insole member is provided having an upper surface generally contoured in conformance with at least the bottom surface of the foot rearwood of the metatarsal head area and containing the above-defined heel insole member as a heel-supporting section in integral, contiguous and continuous combination with a longitudinal medial arch-supporting section comprising a lower posting portion at the bottom surface thereof underlying the area of the longitudinal medial arch of the foot, the upper surface of said latter lower posting portion generally sloping upwards towards the crest region at the outer edge of the medial side of said arch-supporting section, the thickness of the remaining upper portion of said arch-supporting section increasing as the thickness of said latter lower posting portion decreases in directions further away from said crest region, said latter lower posting portion being also less elastically compressible than said latter remaining upper portion.

Preferred means which are provided herein for such attainment are explained in the following description and the accompanying drawings in which.

In the several figures of the drawing, like reference characters indicate like parts of said insole member.

Figure 1:
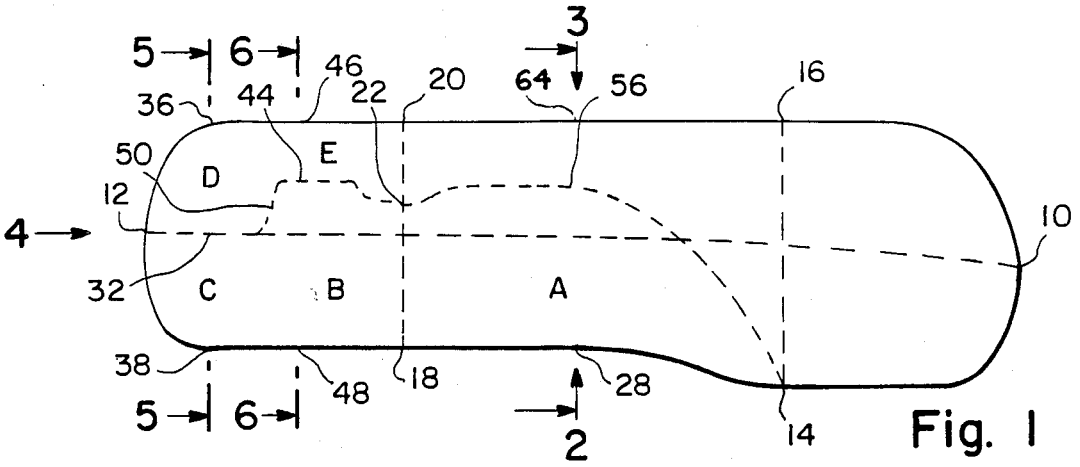
FIG. 1 is a plan view from above of a preferred embodiment of a left foot insole member of this invention.

Referring to FIG. 1, the broken line joining 10 and 12 may be referred to as the longitudinal axis generally dividing the lateral area or side (bound by lines joining 10, 16, 20, 12 and 10) from the medial area of side (bound by lines joining 10, 14, 18, 12 and 10). Lines joining 10, 16, 20 and 12 define the outer edge of the lateral side and lines joining 10, 14, 18 and 12 define the outer edge of the medial side. The heel-supporting section is generally bound by lines joining 18, 12, 20 and 18, the longitudinal medial arch-supporting section is generally bound by lines joining 14, 16, 20, 18 and 14, and the optional metatarsal head- and toe-supporting section is generally bound by lines joining 10, 14, 16 and 10. The curvilinear broken line joining 14, 22 and 12 identifies the apex or lowest or thinnest edge of the less elastically compressible cupped wedge-like lower posting portion at the bottom surface of the insole member, the upper surface of said lower posting portion being generally covered by the more elastically compressible upper portion and generally sloping upwards towards the outer edge of the medial side identified by the line joining 14, 18 and 12. A identifies the area supporting the longitudinal medial arch and B and E identify the heel areas or segments anterior to, respectively, the areas or segments C and D underlying the medial and lateral calcaneal tubercles.

Figure 2:
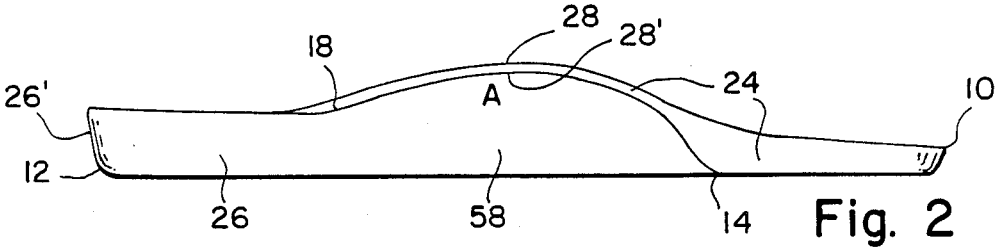
FIG. 2 is a medial side view of the insole member of FIG. 1 from the direction of arrow 2.
Figure 3:
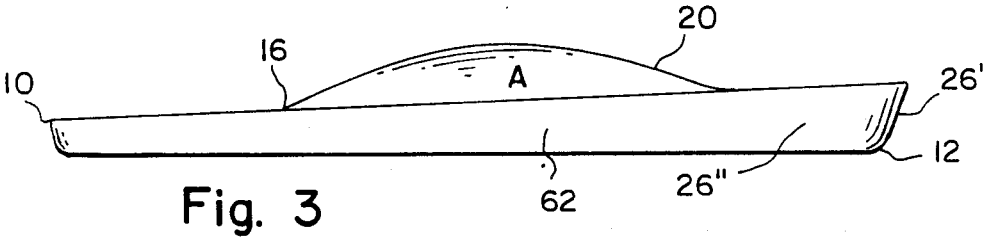
FIG. 3 is a lateral side view of the insole member of FIG. 1 from the direction of arrow 3.

FIGS. 2 and 3 show the preferred but non-essential sloping of the upper surface of the insole member downwardly from heel to toe. The medial view in FIG. 2 shows the upper more elastically compressible portion 24 covering substantially the entire upper surface of the insole member except, as preferred, around the outer edge of the heel-supporting section (lines joining 18, 12 and 20) preferably but not essentially provided with a stiffening side wall 26 of the less elastically compressible material (also shown in FIGS. 2–6 as 26′ and 26″). FIGS. 2 and 3 also show the crest regions 28 and 28′ of, respectively, the member and the lower posting portion (see FIG. 7).

Figure 4:
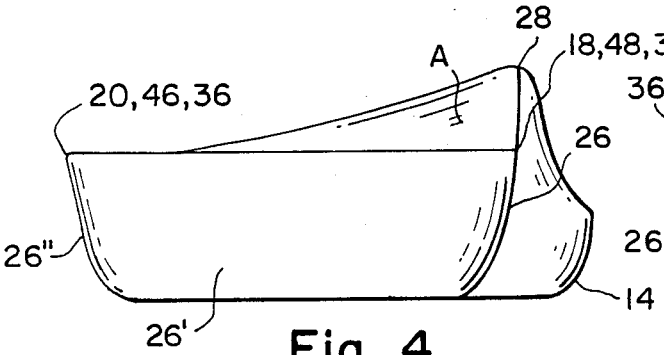
FIG. 4 is an approximately doubly enlarged rear view of the insole member of FIG. 1 from the direction of arrow 4.

FIG. 4 further shows the crest region 28 as the most elevated point in the arch-supporting section, and stiffened rear medial and lateral side walls 26′, 26 and 26″ respectively, in the heel-supporting section.

Figure 5:
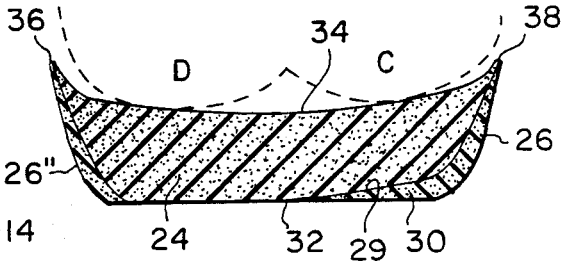
FIG. 5 is an approximately doubly enlarged transverse cross-sectional view taken along lines 5—5 of FIG. 1.

The broken lines in FIG. 5 show the medial and lateral calcaneal tubercles of the heel, C and D respectively, in non-weight bearing position. The lower less elastically compressible posting portion 30 is shown cupped wedge-shaped with its apex at 31 at the bottom surface approximately below the juncture of the medial and lateral calcaneal tubercles. The upper surface 29 of posting portion 30, preferably curved to cup the heel, slopes upwards towards the medial side wall 26 of the heel section. Since the posting angle of elevation from the horizontal at the apex 32 is but little more than 0° (the upper surface 29 of the posting wedge being feathered or substantially tangential to the bottom surface), and gradually increases to perhaps 45° or more as the said upper surface in its preferred form curves upwards towards said medial side wall 26, reference to a specific posting angle is of little significance unless perhaps it refers to an average value, or said upper surface of the posting wedge is, less preferably, planar (straight in transverse cross-section). Posting wedge 30 could, less preferably extend further laterally, i.e. with its apex 32 terminating anywhere under the the lateral calcaneal tubercle D, but for better biomechanical functions apex 32 preferably does not extend substantially past the medial side, as shown, or may even, again less preferably, terminate on the medial side under the medial calcaneal tubercle. The upper surface 34 of the upper more elastically compressible portion 24 is preferably contoured in conformance with the bottom surface of the heel of the foot. The lateral side of the member, under D, and the medial side of the member, under C, in this heel-supporting section are preferably as shown of substantially similar thickness (or height) at points transversely equidistant from the outer edges thereof, respectively 36 and 38, whereby the thickness of the upper more elastically compressible portion 24 increases as the thickness of the lower less elastically compressible posting portion 30 decreases towards the lateral side (i.e. towards its apex 32) of the member. It will be seen that, as preferred, this heel-supporting section is transversely substantially symmetrical.

Figure 6:
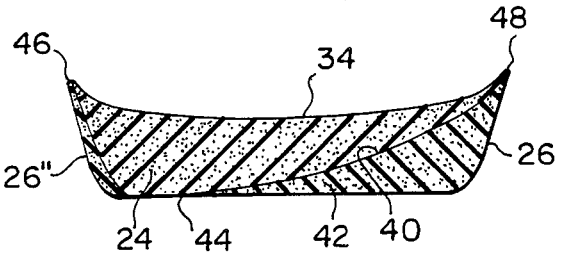
FIG. 6 is an approximately doubly enlarged transverse cross-sectional view taken along lines 6—6 of FIG. 1.

FIG. 6 shows a transverse cross-section of the heel-supporting section anterior to the calcaneal tubercles. As shown and preferred, the upper surface 40 of the lower less elastically compressible lower cupped wedge-shaped posting portion 42 with its apex at 44, has a substantially greater transverse upward posting slope than the remainder of said lower posting portion beneath the calcaneal tubercles as shown in FIG. 5. Stated otherwise, the posting angle of elevation of the lower posting portion in this cross-section increases substantially more rapidly from its apex 44 towards the medial side wall 26 relative to the posterior lower posting portion beneath the calcaneal tubercles. From still another aspect, at equal distances from their apicies in a medial direction, the area under the upper surface 40 of lower posting portion 42 is substantially greater than the area under the upper surface 29 of lower posting portion 30. As also preferred, the lower posting wedge portion 42 extends transversely relatively further towards the lateral side wall 26″, whereby apex 44 is at the bottom surface of the member anterior to the lateral calcaneal tubercle, i.e. on the laleral side of said member, even up to the lateral side wall 26″ of the heel-supporting section. Less preferably, posting wedge 42, and its apex 44, may not extend past the medial side of said member. Like the section shown in FIB. 5, the FIG. 6 section has its upper surface contoured and continuous with the same upper surface in FIG. 5, and is also transversely substantially symmetrical between its outer lateral edge 46 and its outer medial edge 48 whereby the thickness of the upper more elastically compressible portion 24 increases as the thickness of the lower posting wedge 42 decreases towards its apex 44.

It will be understood that the cross-sectional wedges referred to herein are actually cross-sections of three-dimensional chisel-shaped or -edge posting portions, that the rearward edge of posting portion 42 on the lateral side has its apex on the bottom surface along a substantially transverse line substantially under the anterior edge or margin of the lateral calcaneal tubercle as shown at 50 in FIG. 1, that the upper surface 40 of the medial side of the thicker posting portion 42 (under B, FIG. 1) slopes rearwardly downward to connect smoothly with the upper surface 29 of the relatively thinner posting portion 30 under the medial calcaneal tubercle (under C, FIGS. 1 and 5), and that the slope of the upper surface 40 generally conforms with the contour of the plantar surface of the calcaneus as it sits in or about its neutral position, and that if only a heel-supporting footwear member is to be provided according to one aspect of this invention, the forward edge of such heel-supporting member will coincide with line 18–20 of FIG. 1 or a line closely parallel thereto or a curvilinear line adjacent thereto. Such foward edge may be vertical, or may slope forward and downward to an epex at its bottom surface, or may be shaped to fit the rearward edge of a separately or subsequently applied longitudinal medial arch-supporting member or section, or otherwise.

Figure 7:
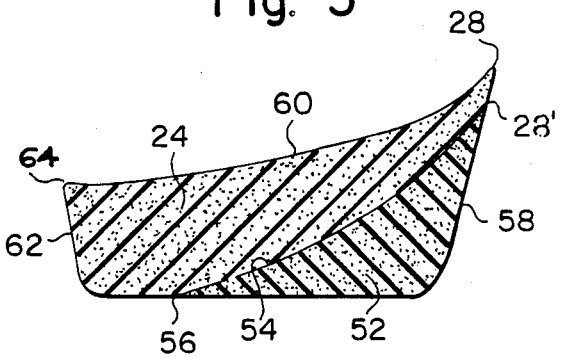
FIG. 7 is an approximately doubly enlarged transverse cross-sectional view taken from the rear along arrows 2-3.

FIG. 7 shows a transverse cross-section of the longitudinal arch-supporting section along arrows 2–3 from the rear looking towards the toe area. The upper surface 54 of lower less elastically compressible posting portion 52 slopes generally downward from its crest region at 28′ of the medial side wall 58 transversely to its apex 56 at the bottom surface of the lateral side of said member. Said upper surface 54 of the lower posting portion 52 also slopes downwardly from its crest region 28′ forwardly in the direction of the metartarsal head and toe section and rearwardly to connect smoothly with the upper surface 40 of the lower posting portion 42 in the heel-supporting section, being generally contoured in conformance with the longitudinal medial arch of the foot. The upper surface 60 of the upper more elastically compressible portion 24 also slopes downwardly from its crest region 28 towards the lateral side wall 62 forwardly in the direction of the metatarsal head and toe section and rearwarly to connect smoothly with the upper surface 34 of the heel-supporting section, but at a gentler, lesser slope whereby its thickness, as in the heel-supporting section, also increases and the thickness of the lower posting portion 52 decreases in directions away from the crest region. Less preferably, the upper surface 60 may be planar, horizontal, or symmetrically cupped like surface 34 in FIGS. 5 and 6, i.e. with lateral edge 64 and crest 28 at the same height.

It will thus be seen that the heel-supporting insole member of this invention provides the needed additional cushioning, stock absorbing, spring-like action as the heel descends from non-weight-bearing (at the start of the gait cycle) to weight-bearing position by reason of the increased thickness of the upper more elastically compressible portion especially on the lateral (heel contact) side. Because of the symmetrical transverse cross sectional dimensions and elastic compressibility differential, the heel is automatically positioned properly (not askew) in the shoe after each, and at the start of the next, gait cycle. Other advantages of this member are exceptional cushioning on impact, control of the torsional forces of the leg manifested in the rearfoot, control of anterior posterior, medial and lateral shear forces, force components and velocities and lowering of the lateral column of the foot to prepare the foot to function as a rigid lever for the propulsive phase in the gait cycle.

The posting portion at the anterior margin of the calcaneal tubercles, with its greater posting slope or elevation and further with its apex past the medial side and at the bottom surface anterior to the lateral calcaneal tubercle, thereby underlying the plantar surface of the body of the calcaneus in its approximately neutral, corrected or raised position, provides still further advantages. More specifically, it offers control or resistance to the anterior posterior (aft shear) shear components of force and velocity (prevent anterior medial roll of heel and thereby elongation or braking action of the foot or excessive pronation of the rearfoot complex).

As shown, additional cushioning, shock-absorbing, spring-like action is also provided in the arch-supporting section by reason of the increased thickness of the upper more elastically compressible portion overlying the less elastically compressible lower posting portion.

It will be understood that within the scope of my invention, variations and modifications of the preferred embodiments shown for illustrative purposes only in the drawing will become obvious, and in some instances advisable or even necessary, to those skilled in the art. By way of example, and depending upon such factors as the foot type, foot size, foot shape, foot sensitivity, weight, age, etc. of the user, the type of footwear, the activity contemplated, the ground surface to be encountered, etc., points 16, 20, 18 and 14 may be shifted as deemed advisable in either direction along the periphery of the insole member, the shape and location of the curvilinear line 12-22-14 may be changed, e.g., its intersection at 22 may be shifted in either direction along line 18–20, it may curve more or less into the lateral area, and/or its terminus at 14 may not coincide with the line 16–14 demarking the rearward edge of the matatarsal area, the shape and size of the insole member may be varied, etc.

Preferably but not necessarily the lower or bottom surface of the insole member is essentially planar (it may be transversely or longitudinally grooved or ridged) and its upper surface is contoured in approximate conformance with the bottom surface of the foot, and the thickness of the insole member may vary from about ⅛" to 2", preferably generally decreasing from heel to toe and preferably but not necessarily decreasing from medial arch to lateral side with suitable cupping in such areas as the heel and the ball of the foot. The insole member of this invention may be provided for insertion into existing footwear or it may be made part of the original construction of the footwear.

An essential feature of this invention involves the use of elastically compressible or resilient material (e.g. with 100% rebound or elastic memory). This material may be natural or synthetic and solid (non-cellular) or cellular (e.g. multichambered, foam, sponge, microcellular, macrocellular, honeycombed). The degree of compressibility resilience, elasticity or flexibility of these materials may be controlled, adjusted and predetermined in known manner, e.g. by suitable selection of density cell size, cell wall thickness degree of polymerization and/or cross-linking, content of plastizicers and other components, etc. Examples of such generally elastomeric material include latex, natural rubber, butyl rubber, BSR (butadiene/styrene rubber), ABS rubber (acrylonitrile/butadiene/styrene terpolymer), neoprene, polyethylene, polyurethane, other plastics, copolymers and interpolymers thereof, etc. A cellular foam structure, especially to minimize weight, is preferred which may be closed celled or opencelled (permitting transfer of fluid between cells with further shock-absorbing effect under weight-bearing conditions). The cellular material may contain any suitable fluid in its cells, e.g. air or any other gas or water or any other suitable liquid. A polyurethane cellular foam material is preferred. The less elastically compressible (less resilient, harder, more rigid, etc.) lower posting portions which are almost inherently also less flexible, may be the same or different in chemical composition and physical structure from the upper, more elastically compressible softer portions of the insole member, and such portions are preferably (but not necessarily) contiguous with each other. Such posting portions may be more dense, contain smaller cells and/or thicker cell walls, and/or made of an entirely different less elastically compressible material relative to the remaining portions of the insole member.

It will be understood that the term "elastically compressible" as employed herein refers to such properties as resiliency, resistance to compression deformation, elastic memory, reversible compressibility, etc. The lower less elastically compressible posting portions are harder, more rigid, more resistant to compression deformation, and correspondingly of greater rebound (spring-like) force to their original non-weight bearing thickness, relative to the softer cushioning upper more elastically compressible portions. The degree of such compressibility of the lower posting portions and upper cushioning portions is not readily susceptible of precise limitative definition being dependent on and optimally predeterminable by routine testing for, such factors and indicated above, including the foot type, foot size, foot shape, foot sensitivity, weight, age, general physical condition, etc. of the user, the type of footwear, the activity contemplated, the ground surface to be encountered, etc. Without being bound thereby, the lower posting portions should generally be sufficiently resistant to compression to achieve the biomechanical functions and advantages of posting means known and recognized in the art, and should generally be from about 10% to 200% or more less elastically compressible, e.g. resistant to compression, than the softer shock absorbing upper portions.

The degree of slope or angle of elevation of the lower posting portions is also dependent on the aforesaid factors, but is somewhat more susceptible of limitative definition. Without being bound thereby, the average degree of slope or posting angle of elevation of the lower posting portion under the calcaneal tubercles may range from about 0° to about 10°, preferably about 2° to 8°, and the average degree of slope or posting angle of elevation of the lower posting portion in the heel-supporting section anterior to the calcaneal tubercles should preferably be substantially more, e.g. about 20% to about 200% more, and generally within the range of about 2° to about 45°, preferably about 5° to 35°.

The insole member may be made in any suitable manner, as by injection molding (double injection, biphase single injection) vacuum or blow molding, etc. using suitable elastomeric material. The upper portions and lower posting portions may be bonded to each other and/or to the remaining portions of the insole member during the molding or other forming operation, or they may be separately made and then assembled by suitable bonding at their juxtaposed or adjacent surfaces by means of heat and/or adhesive, etc., or without bonding on a sheet material (disposable or permanent).

The insole member of this invention provides a heretofore unattainable dynamic biomechanical system yielding multiple unexpected advantages in foot and gait control. This system permits the lateral column of the foot to depress in a piston-like or spring-like action with each step, controls internal torque from the leg (in the first portion of the gait cycle), and redirects the torque of the leg in an external direction by allowing the lateral column of the foot to depress and invert (2nd portion of the gait cycle, slightly before midstance). The novel structure of this insole member for example (1) prevents excessive medial roll of the heel in the first portion of the gait cycle so as to function as a tri plane wedge, and (2) it forces the heel and lateral column of the foot to invert on full weight bearing (as approaching the midstance phase of the gait), thereby stabilizing the foot making it a rigid lever for the propulsive phase of the gait. It provides a piston-like or spring-like action under weight bearing with each step so that there is a constant return to its original shape after weight-bearing has ceased. It provides a mechanical advantage to the subtalar joint toward supination so that lowering of the lateral column will occur more efficiently and sooner in the gait cycle. The foot therefore becomes a rigid lever at the time it is needed in the gait cycle when full body compression occurs. It limits excessive pronation in the initial portion of the gait cycle and prevents excessive excursion of the posterior calcaneal facet (heel articulation) thereby preventing excessive migration of the talus (ankle bone) off the calcaneus (heel bone). Since the subtalar joint and the midtarsal joint can only move either clockwise or counter clockwise, the medial contact on the less elastically compressible area will cause the heel to invert, causing the lateral column of the foot to depress and invert. This causes the midtarsal joint to move antagonistically to the supinating subtalar joint and pronate maximally thereby stabilizing the foot. The system allows the plantar fascia to act as a more efficient truss system in metatarsal plantar flexion and stability. It also allows the muscles to functionally contract at mechanical advantages for optimum foot mechanics.

The insole member of this invention is useful in all types of footwear, therapeutic or not, work or play, inactive or active, including for example all types of athletic shoes and boots, walking, jogging and running shoes, army boots, ski shoes, climbing boots, sneakers, slippers etc.

The invention has been disclosed with respect to preferred embodiments, and various modifications and variations thereof obvious to those skilled in the art are to be included within the spirit and purview of this invention and the scope of the appended claims.

What is claimed is:

1. A footwear insole member underlying a wearer's foot and comprising a posting portion extending within at least a part of each of the portions of the insole member which underlies the medial heel and medial arch segments of the wearer's foot, said posting portion being less elastically compressible than the remaining portion of said insole member, said insole member having an uppper surface which is generally contoured both longitudinally of and transversely across said insole member in conformance with the bottom surface of at least the heel of the foot, said insole member having lateral and medial sides transversely across said insole member respectively at the lateral and medial sides of the wearer's foot, said lateral and medial sides of said insole member being of substantially similar thickness at points equidistant from the outer edges thereof, said posting portion having a segment underlying the anterior of the calcaneal tubercles and said segment having a substantially greater upward posting slope transversely across said insole member than the segment of said posting portion beneath the calcaneal tubercles.

2. A footwear insole member according to claim 1 wherein segment of the posting portion underlying the anterior of the calcaneal tubercles extends transversely from the medial side wall of said member to the bottom surface of said member anterior to the lateral calcaneal tubercle, and further wherein the posting porting is thicker at the medial side of the member and the upper surface of the posting portion, in transverse cross-section, slopes generally upward toward the medial side wall of said member.

3. A footwear insole member according to claim 1 wherein the segment of the posting portion beneath the calcaneal tubercles extends transversely from the medial side wall of said member to the bottom surface of said member substantially beneath the medial calcaneal tubercle.

4. A footwear insole member according to claim 1 constructed of elastomeric foam material.

5. A footwear insole member having an upper surface generally contoured in conformance with the bottom surface of the foot and comprising a heel-supporting section and a longitudinal medial arch-supporting section said heel-supporting section comprising, in transverse cross-section, a posting portion thicker at the medial side of the member, and the upper surface of which generally slopes upwards towards the medial side wall of said member, the lateral and medial sides of said heel-supporting section being of substantially similar thickness at points equidistant from the outer edges thereof, said arch-supporting section comprising a posting portion thicker at the medial side of the member underlying the area of the longitudinal medial arch of the foot, and the upper surface of said posting portion generally sloping upwards towards the crest region at the outer edge of the medial side of said arch-supporting section, said heel and arch posting portions being less elastically compressible than said remaining at least a part of each of said heel and arch posting portions being less elastically compressible than the remaining portion of the insole member.

6. A footwear insole member according to claim 5 wherein the segment of the posting portion underlying the anterior of the calcaneal tubercles has a substantially greater transverse upward posting slope than the posting portion beneath the calcaneal tubercles.

7. A footwear insole member according to claim 6 wherein said segment of the posting portion underlying the anterior of the calcaneal tubercls extends transversely from the medial side wall to the bottom surface anterior to the lateral calcaneal tubercle.

8. A footwear insole member according to claim 6 wherein the segment of the posting portion in the heel-supporting section extends transversely from the medial side wall of said heel-supporting section to the bottom surface of said heelsupporting section substantially beneath the medial calcaneal tubercle.

9. A footwear insole member according to claim 5 constructed of elastomeric foam material.

* * * * *